US011421482B2

(12) United States Patent
Graham et al.

(10) Patent No.: US 11,421,482 B2
(45) Date of Patent: Aug. 23, 2022

(54) HOLE OPENER FOR DIRECTIONAL DRILLING

(71) Applicant: Precise Drilling Components Ltd, Calgary (CA)

(72) Inventors: Cody D. Graham, Calgary (CA); Jeffrey S. Mueller, Brownsville, WI (US)

(73) Assignee: Precise Drilling Components Ltd, Calgary (CA)

( * ) Notice: Subject to any disclaimer, the term of this patent is extended or adjusted under 35 U.S.C. 154(b) by 46 days.

(21) Appl. No.: 16/937,683

(22) Filed: Jul. 24, 2020

(65) Prior Publication Data

US 2021/0025243 A1 Jan. 28, 2021

Related U.S. Application Data

(60) Provisional application No. 62/878,224, filed on Jul. 24, 2019.

(51) Int. Cl.

| | |
|---|---|
| ***E21B 10/28*** | (2006.01) |
| ***E21B 7/28*** | (2006.01) |
| ***E21B 10/633*** | (2006.01) |
| ***E21B 10/567*** | (2006.01) |
| ***E21B 7/04*** | (2006.01) |

(52) U.S. Cl.

CPC ..... *E21B 10/28* (2013.01); *E21B 7/046* (2013.01); *E21B 7/28* (2013.01); *E21B 10/567* (2013.01); *E21B 10/633* (2013.01)

(58) Field of Classification Search

CPC ..... E21B 10/28

See application file for complete search history.

(56) References Cited

U.S. PATENT DOCUMENTS 2,058,628 A * 10/1936 Reed ..... E21B 10/28 175/344

2,086,680 A * 7/1937 Scott ..... E21B 10/28 175/335

(Continued)

FOREIGN PATENT DOCUMENTS

WO 2016135511 A1 9/2016

OTHER PUBLICATIONS

Office Action issued from the Canadian Patent Office for related Application No. 3087890 dated Oct. 14, 2021 (5 Pages).

*Primary Examiner* — Blake Michener

(74) *Attorney, Agent, or Firm* — Michael Best & Friedrich LLP

(57) ABSTRACT

A hole opener configured for use with a directional drilling rig and the hole opener includes a shaft and slots that extends along the shaft. Blades extend radially outward from the shaft and are each received within one of the slots to couple the blades to the shaft for rotation with the shaft and to space the blades apart around the shaft. The hole opener further includes saddles. Each of the saddles includes a slot that receives one of the blades to couple the saddle to the blade and the shaft for rotation with the blade and the shaft. The saddles each include a recess. The hole opener further includes cutters and each of the cutters is received within one of the recesses of the saddles to couple the cutters to the shaft for rotation with the shaft and to space the cutters around the longitudinal axis of the shaft.

20 Claims, 6 Drawing Sheets

(56) References Cited

U.S. PATENT DOCUMENTS

| | | | | | |
|---|---|---|---|---|---|
| 2,086,751 | A * | 7/1937 | Taylor | E21B 10/28 | 175/336 |
| 2,090,356 | A * | 8/1937 | Reed | E21B 10/28 | 175/340 |
| 3,917,011 | A * | 11/1975 | Hester | E21B 10/18 | 175/339 |
| 5,027,914 | A * | 7/1991 | Wilson | E21B 10/26 | 175/406 |
| 5,337,843 | A | 8/1994 | Torgrimsen et al. | | |
| 5,628,585 | A * | 5/1997 | Parish, II | E21B 7/20 | 405/184 |
| 5,979,574 | A * | 11/1999 | Osadchuk | E21B 7/046 | 175/353 |
| 6,386,298 | B1 * | 5/2002 | Smith | E21B 10/20 | 175/406 |
| 6,745,858 | B1 * | 6/2004 | Estes | E21B 10/20 | 299/85.2 |
| 7,152,702 | B1 * | 12/2006 | Bhome | E21B 10/345 | 175/413 |
| 10,113,369 | B1 * | 10/2018 | Barbera | E21B 7/046 | |
| 10,428,586 | B2 * | 10/2019 | Wagner | E21B 10/30 | |
| 2004/0188141 | A1 * | 9/2004 | Slaughter, Jr. | E21B 10/28 | 175/53 |
| 2006/0180354 | A1 * | 8/2006 | Belnap | E21B 10/573 | 175/374 |
| 2010/0206638 | A1 * | 8/2010 | Bielawa | E21B 10/28 | 175/356 |
| 2014/0338984 | A1 * | 11/2014 | Maher | E21B 10/25 | 175/336 |
| 2017/0167202 | A1 * | 6/2017 | Wagner | E21B 7/28 | |
| 2020/0277822 | A1 * | 9/2020 | Graham | E21B 7/046 | |

* cited by examiner

HOLE OPENER FOR DIRECTIONAL DRILLING

CROSS-REFERENCE TO RELATED APPLICATIONS

This application claims priority to U.S. Provisional Patent Application No. 62/878,224, filed Jul. 24, 2019, the entire contents of which are hereby incorporated by reference herein.

BACKGROUND

The present invention relates to a hole opener particularly suited for use with a directional drilling rig.

SUMMARY

In one embodiment the invention provides a hole opener configured for use with a directional drilling rig. The hole opener includes a shaft including a first end, a second end, a longitudinal axis that extends through the first end and the second end, and a plurality of slots that extends along the longitudinal axis between the first end and the second end. The plurality of slots are spaced apart around the longitudinal axis and the shaft is configured for rotation about the longitudinal axis by the hole opener. The hole opener further includes a plurality of blades that extend radially outward from the shaft, each of the plurality of blades is received within one of the plurality of slots to couple the plurality of blades to the shaft for rotation with the shaft about the longitudinal axis and to space the plurality of blades apart around the longitudinal axis of the shaft. The hole opener further includes a plurality of saddles, each of the plurality of saddles includes a slot that receives one of the plurality of blades to couple the saddle to the blade and the shaft for rotation with the blade and the shaft about the longitudinal axis, each of the plurality of saddles includes a recess. The hole opener further includes a plurality of cutters, each of the plurality of cutters is received within one of the recesses of the plurality of saddles to couple the plurality of cutters to the shaft for rotation with the shaft about the longitudinal axis and to space the plurality of cutters around the longitudinal axis of the shaft.

In another embodiment, the invention provides a hole opener that includes a shaft including a first end, a second end, a longitudinal axis that extends through the first end and the second end, and the shaft is configured for rotation about the longitudinal axis by a hole opener. The hole opener further includes a plurality of blades that extend radially outward from the shaft, each of the plurality of blades is coupled to the shaft for rotation with the shaft about the longitudinal axis and spaced apart around the longitudinal axis of the shaft. The hole opener further includes a plurality of saddles, each of the plurality of saddles is coupled to one of the plurality of blades and the shaft for rotation with the plurality of blades and the shaft about the longitudinal axis. The hole opener further includes a plurality of cutters, each of the plurality of cutters is coupled to one of the plurality of saddles to couple the plurality of cutters to the shaft for rotation with the shaft about the longitudinal axis and to space the plurality of cutters around the longitudinal axis of the shaft.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
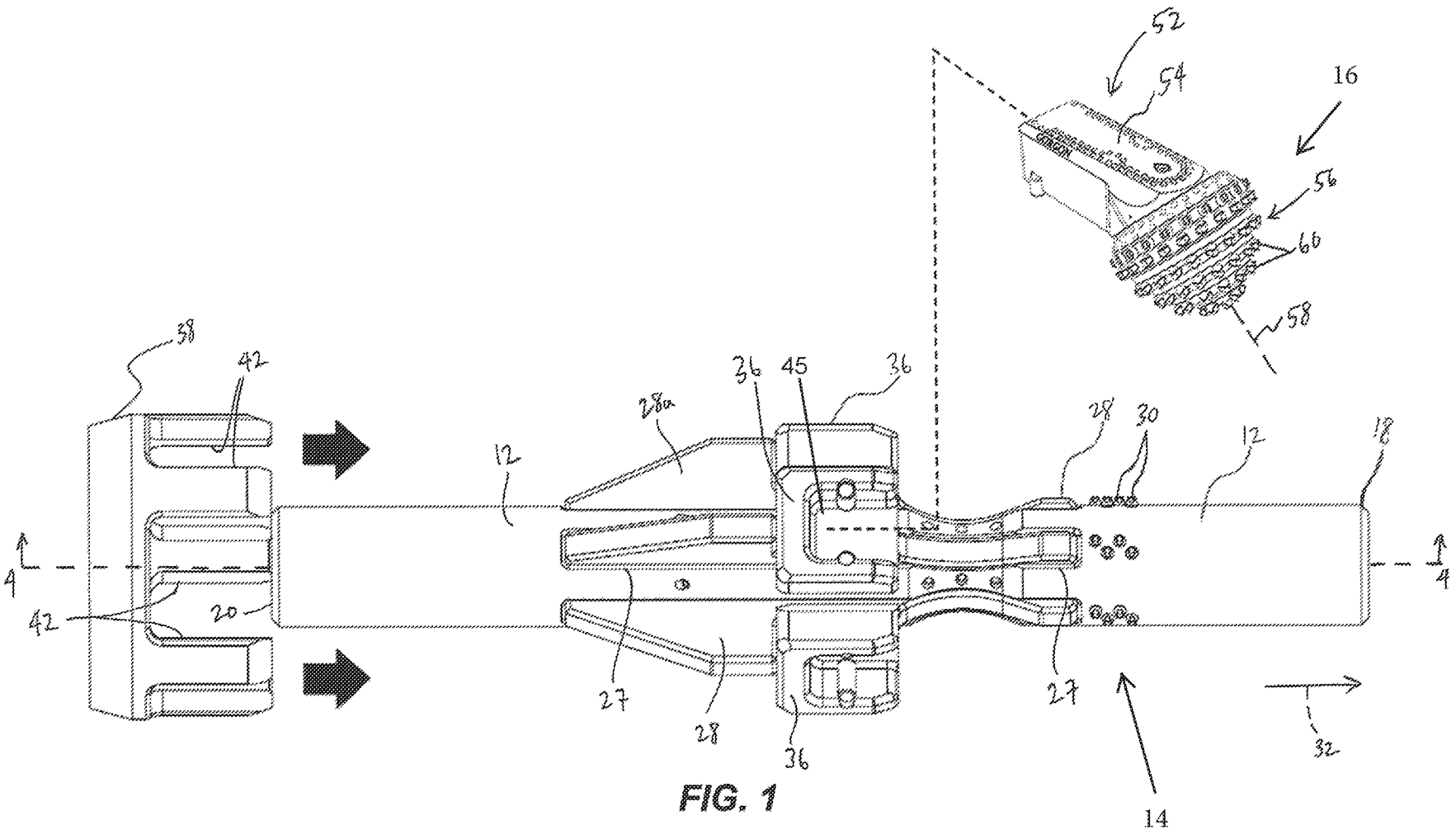
FIG. 1 is a side view of a hole opener according to one embodiment of the invention.
Figure 6:
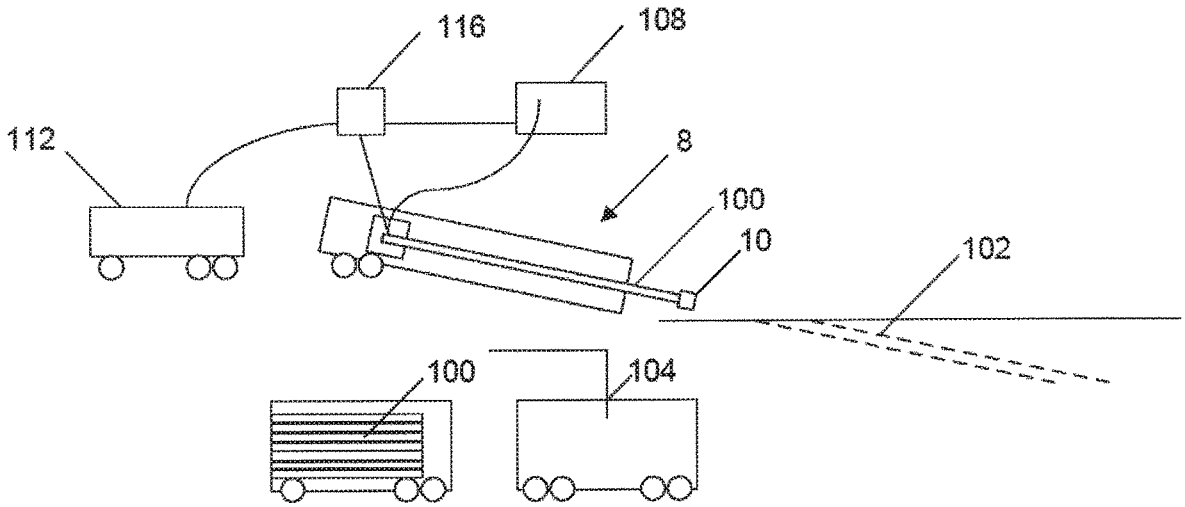
FIG. 6 illustrates a horizontal drilling rig configured for use with the hole opener.

FIG. 1 illustrates a hole opener or reamer 10. The illustrated hole opener 10 includes a shaft 12, a first cutting assembly 14 coupled to the shaft 12 for rotation with the shaft 12, and a second cutting assembly 16 coupled to the shaft 12 for rotation with the shaft 12. The hole opener 10 is particularly suited for use with a horizontal directional drilling rig 8 (FIG. 6) for creating underground bores. The underground bores are used for utilities, including water lines, sewer lines, gas lines, electrical conduits, communication lines or conduits, direct buried electrical wires, and the like. Although the hole opener 10 is particularly suited for use with a horizontal directional drilling rig, in other embodiments, the hole opener 10 can be configured for use with other types of drilling rigs.

Figure 2A:
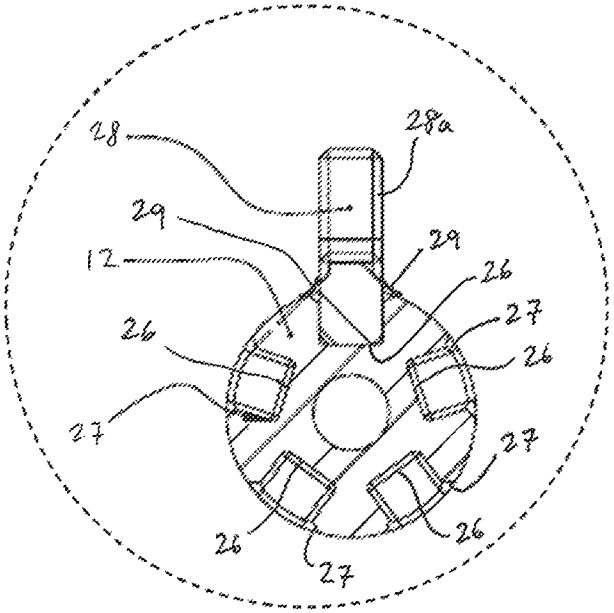
FIG. 2A is a cross-sectional view of the shaft taken along line 2A-2A of FIG. 2.
Figure 2:
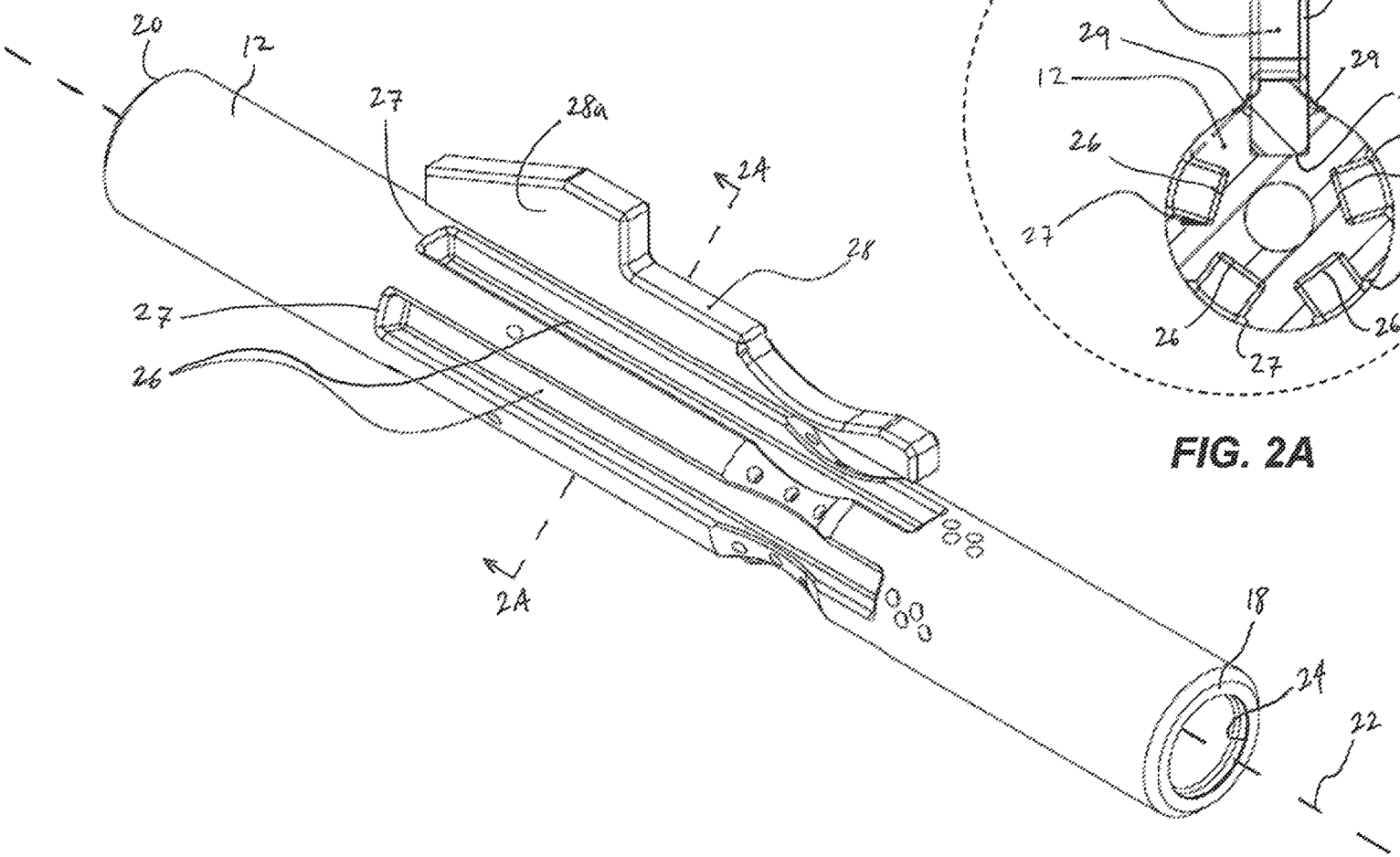
FIG. 2 is a perspective view of a shaft of the hole opener of FIG. 1, with a blade exploded from the shaft.
Figure 4:
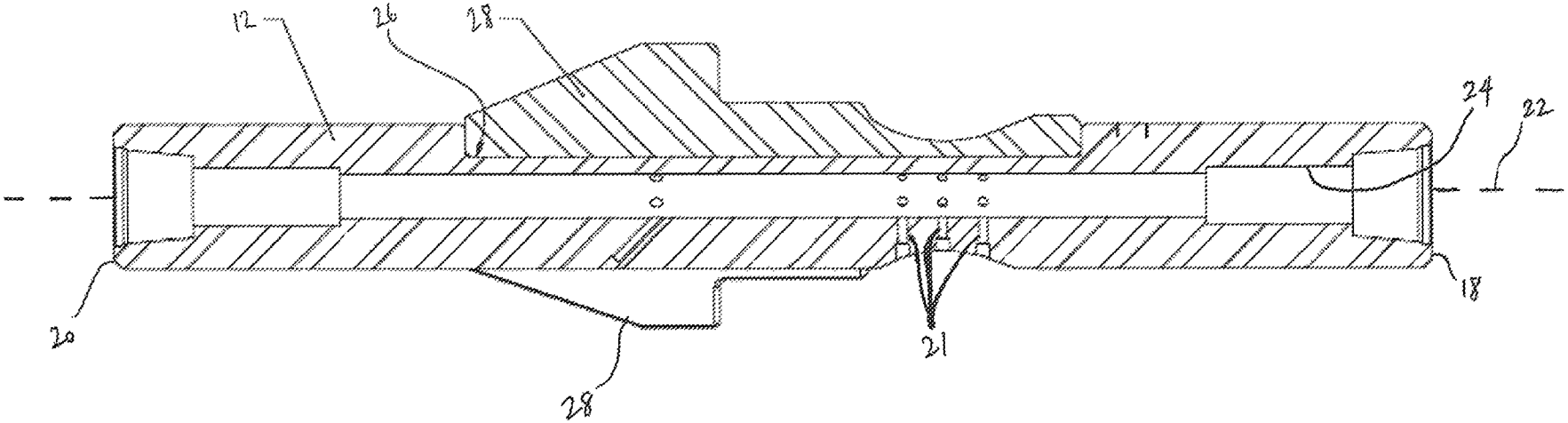
FIG. 4 is a cross-sectional view of the shaft taken along line 4-4 of FIG. 1, illustrating an aperture extending through the shaft.

With reference to FIG. 2, the shaft 12 includes a first end 18 and a second end 20 and a longitudinal axis 22 that extends centrally through the ends 18, 20. An aperture 24 is formed in the first end 18 and the second end 20 of the shaft 12. In one embodiment, the aperture 24 extends through shaft 12 between the first end 18 and the second end 20 to permit a drill fluid to be pumped through the shaft and exit the shaft 12 through duct channels 21 (FIG. 4). The aperture 24 is configured at each end 18, 20 (e.g., threaded connection, pin connection, etc.) to mate with extension rods or drive rods 100 (FIG. 6) to connect the hole opener 10 to the drilling rig 8. Rotation of the extension rods 100 by the drilling rig rotates the shaft 12 about axis 22, which rotates the cutting assemblies 14, 16 to perform the underground boring or drilling operation. The first cutting assembly 14 is coupled to the shaft 12 between the first end 18 and the second cutting assembly 16 and the second cutting assembly 16 is coupled to the shaft 12 between the second end 20 and the first cutting assembly 14.

With reference to FIGS. 2 and 2A, the shaft 12 includes slots 26 that are circumferentially spaced evenly around the axis 22. Although the illustrated shaft 12 includes five keyed slots 26 each spaced approximately 72 degrees apart from each other around the axis 22. In other embodiments, there may be fewer or greater than five slots 26. Each of the slots 26 receive a blade 28 (although only one blade 28 is shown in FIG. 2) to provide strength and force transfer from the shaft 12 to the cutting assemblies 14, 16. The slot 26 allows the blade 28 to be set into the shaft 12 such that a vertical wall 28*a* of the blade 28 is partially encompassed by the shaft 12. The slots 26 each include chamfered edge 27 defining the opening of the slots 26. The chamfered edge 27 allows a fillet weld 29 to run within the chamfered edge 27 for fixing each blade 28 within the corresponding slot 26 of the shaft 12. In one embodiment, a plurality of cutters or chisels 30 are also welded to the shaft 12 as part of the first cutting assembly 14. Welding the chisels 30 to the blades 28 facilitate removal of the cutters 30 when worn or dull and can replaced by welding new cutters 30.

Figure 3A:
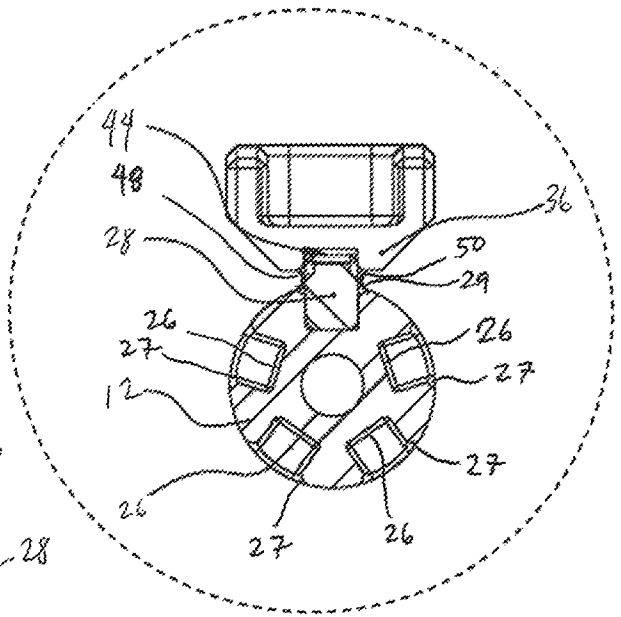
FIG. 3A is a cross-section view of the shaft taken along line 3A-3A of FIG. 3.
Figure 3:
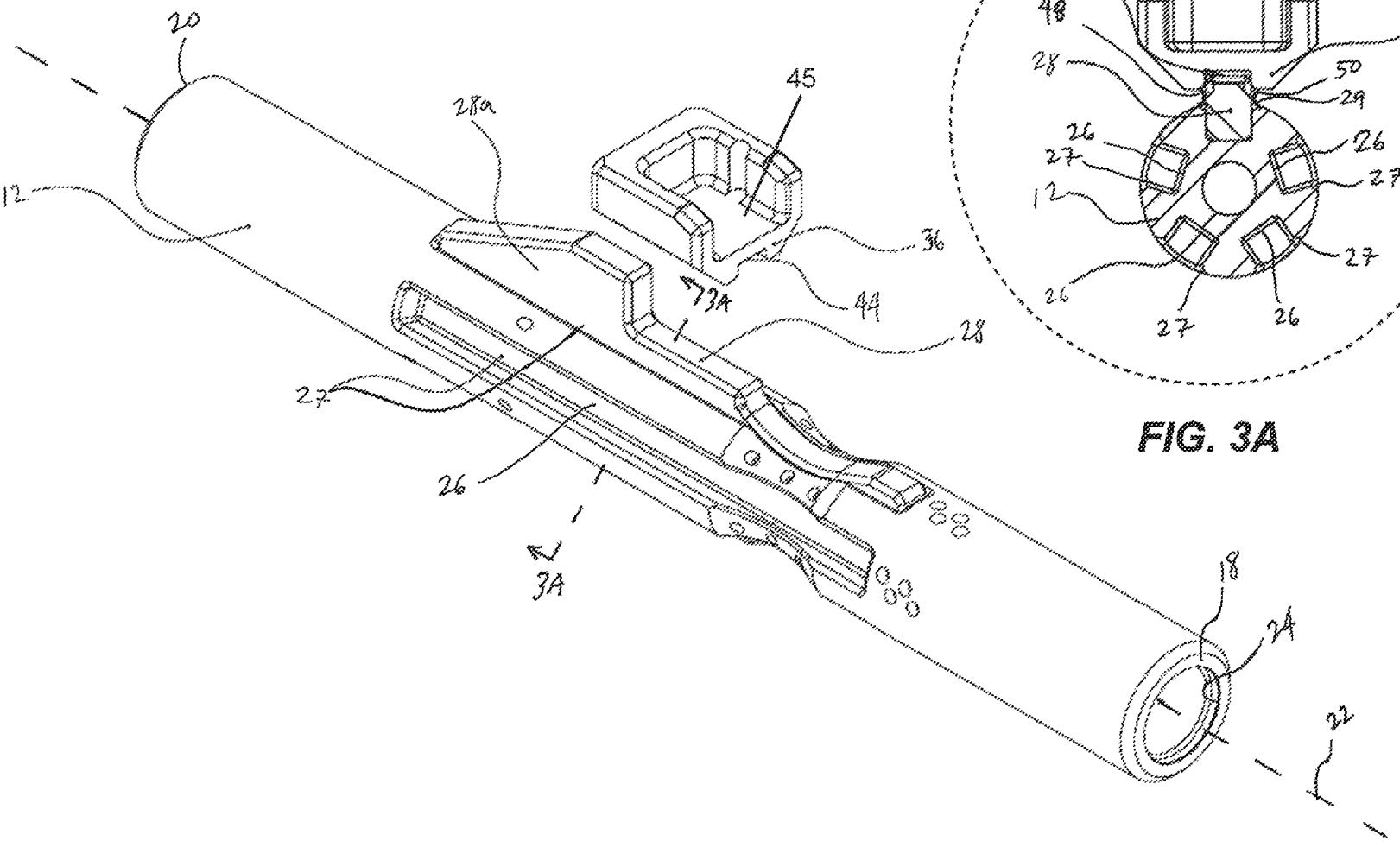
FIG. 3 is a perspective view of the shaft of FIG. 2, illustrating a cradle exploded from the blade.

With reference to FIG. 3, the hole opener 10 further includes a plurality of saddles 36 and a gauge ring 38. The gauge ring 38 is coupled to the shaft 12 such that the gauge ring 38 is fixed to the shaft 12 for rotation with the shaft 12. Specifically, the gauge ring 38 includes saddle recesses 42 that each separately receive one of the saddles 36, thereby intermeshing or interconnecting the gauge ring 38 and the saddles 36. The saddle recesses 42 are circumferentially spaced evenly around the axis 22 to align with the saddles 36.

With reference to FIGS. 3 and 3A, each saddle 36 includes a slot 44 on the underneath side of the saddle 36 and a cutting assembly recess 45 opposite the slot 44. The slot 44 of each saddle 36 receives one of the blades 28. The slot 44 allows the blade 28 to be slotted into the saddle 36, such that a portion of the vertical wall 28*a* of the blade 28 is set into the saddle 36. The slot 44 includes a chamfered edge 48, thereby allowing a fillet weld 50 to run within the chamfered edge 48 for coupling the saddle 36 to the corresponding blade 28. As a result, the saddles 36 are coupled to the shaft 12 and the gauge ring 38 so that the saddles 36 rotate with the shaft about the axis 22.

The second cutting assembly 16 is coupled to the shaft 12 between the first cutting assembly 14 and the second end 20 of the shaft 12. The second cutting assembly 16 further increases the diameter of the underground bore after the first cutting assembly 14. The second cutting assembly 16 includes the gauge ring 38, the saddles 36, and roller cutter assemblies 52 (FIG. 1). The roller cutter assembly 52 is received within the saddles 36. As a result, the roller cutter assemblies 52 rotate with the shaft 12 about the axis 22. Each roller cutter assembly 52 includes a body 54 and a cutter 56. The body 54 is received within the recess 45 of the saddle 36 and in one embodiment, the body is welded to the saddle 36. The cutter 56 is coupled to the body 54 such that the cutter 56 can rotate relative to the body 54 about axis 58. In the illustrated embodiment, the cutter 56 is generally cone shaped. The cutter 56 includes a plurality of chisels 60. In the illustrated embodiment, the cutter 56 is removably coupled to the body 54 so that the cutter 56 can be removed and replaced when the chisels 60 are worn or dull. The cutter 56 can include any suitable cutter including polycrystalline diamond compact cutters, tungsten carbide cutters, and cubic boron nitride cutters.

Figure 5:
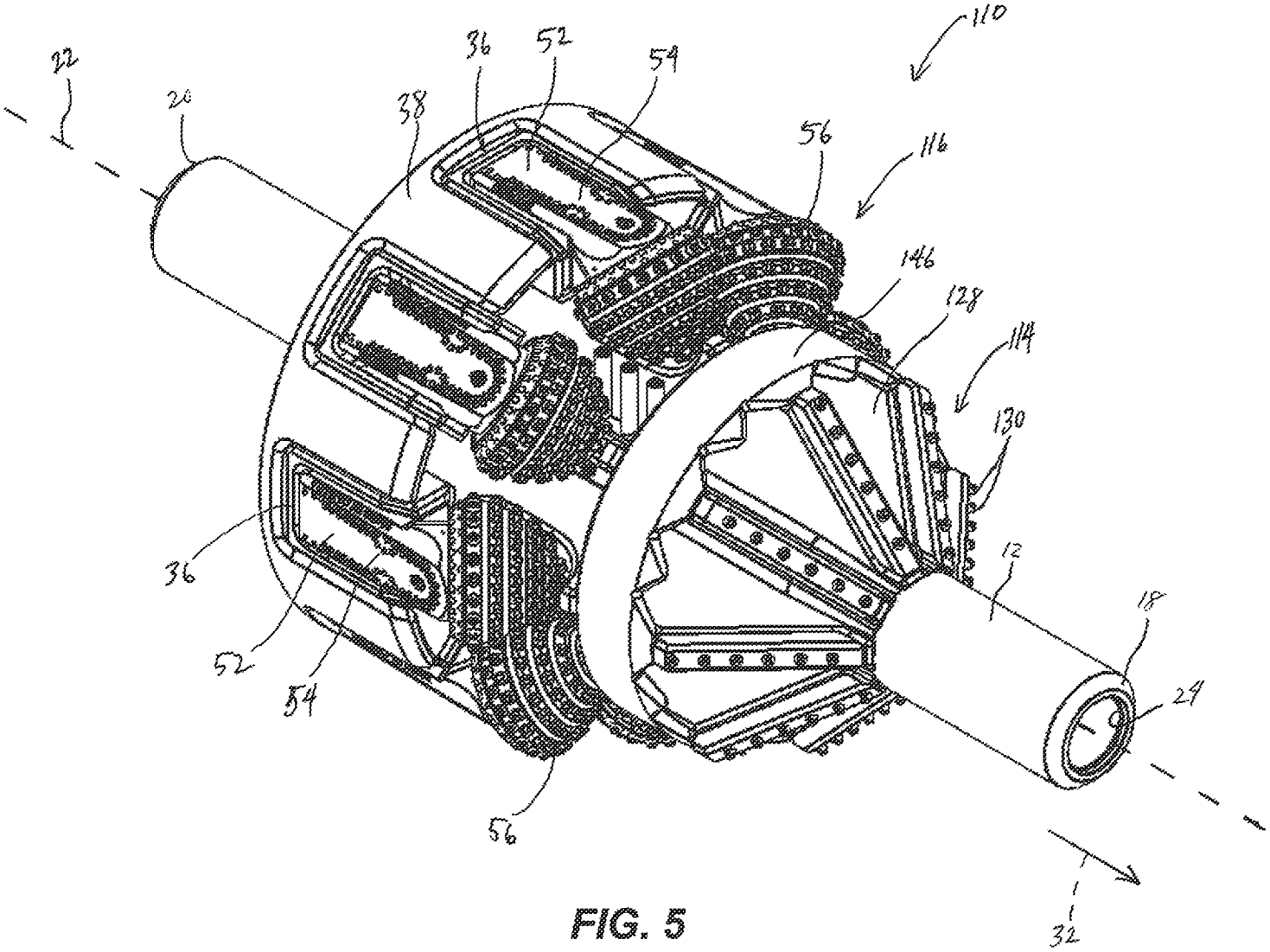
FIG. 5 is a perspective view of a hole opener in accordance with another embodiment of the invention.

In another embodiment, a hole opener 110 may alternatively include blades 128, as shown in FIG. 5. The blade 128 are similar to the blade 28 but are dimensionally larger than the blade 28 to permit increased hole opening. In this embodiment, the first cutting assembly 114 is located on the blades 128, such that the chisels 130 are welded to the blades 128 rather than on the shaft 12. Welding the chisels 130 to the blades 128 facilitate removal of the cutters 130 when worn or dull and can replaced by welding new cutters 130. This way, the chisels 130 have a greater cutting radius. Also, the hole opener 110 includes a toothed ring 146 disposed around the blades 128 between the first and second cutting assemblies 114, 116.

During assembly, each blade 28 is welded to the shaft 12 using the fillet weld 29 along the chamfered edge 27 of the slot 26 (FIG. 2). Subsequently, each saddle 36 is welded to the corresponding blade 28 using the fillet weld 50 along the chamfered edge 48 of the keyed slot 44 (FIG. 3). Next, the gauge ring 38 is slid over the shaft 12 until each saddle recess 42 receives the corresponding saddle 36 (FIG. 3). The gauge ring 38 is intermeshed between adjacent saddles 36 and blades 28 to increase the rigidity and of the entire hole opener 10 and assist with the transfer of forces throughout the entire hole opener 10 during operation. The gauge ring 38 is welded to the saddles 36. At this point, the roller cutter assemblies 52 are coupled to the saddles 36 the bodies 54 of the assemblies 52 welded to the respective saddle 36. The chisels 30, 60 may be welded to the hole opener 10. If any of the components (i.e., chisels 30, 60, roller cutter assemblies 52, etc.) become worn or damaged, any of the fillet welds 29, 50 may be routed out to the chamfered edges 27, 48 in order to remove the connection between the specific components. This way, single components can be individually replaced rather than entire assemblies to save material and cost.

The hole opener 10 is pushed or pulled underground in the direction of arrow 32 in FIG. 1 while the hole opener 10 rotates about the axis 22. The first cutting assembly 14 increases the diameter of the underground bore as the hole opener 10 travels in the direction of arrow 32, while the second cutting assembly 16 further increases the diameter of the underground bore as compared to the first cutting assembly 14.

In the drilling operation, extension rods 100 (FIG. 6) are moved by the crane 104 onto the drill rig 8. The extension rods 100 are translated through a hole 102 to be reamed to the opposite end (not shown) of the hole 102, with additional extension rods 100 being added to the extension rods 100 within the hole 102 as the extension rods 100 are translated through the hole 102. The extension rods 100 are attached to the hole opener 10. An operator in the control trailer 108 supplies power through the power unit 116 to the drill rig 8 to rotate the hole opener 10 and translate the hole opener 10 along a cutting path of the hole 102. In some embodiments, the cutting path of the hole 102 is directed towards the drill rig 8, and the hole opener 10 is pulled through the hole 102, In this embodiment, the crane 104 lifts extension rods 100 from the drill rig 8 as they are translated out of the hole 102. Alternatively, the cutting path of the hole 102 can be directed away from the drill rig 8, and the hole opener 10 is pushed through the hole 102 by the drill rig 8. In this alternative embodiment, the crane 104 lifts extension rods 100 to apply them to the drill rig 8 as they are needed to further translate the hole opener 10 through the hole 102. During drilling, cuttings from within the hole 102 created by the hole opener 10 are excavated into the mud rig 112 for removal from the reamed hole 102.

What is claimed is:

1. A hole opener configured for use with a directional drilling rig, the hole opener comprising:

a shaft including a first end, a second end, a longitudinal axis that extends through the first end and the second end, and a plurality of slots that extends along the longitudinal axis between the first end and the second end, the plurality of slots spaced apart around the longitudinal axis, the shaft configured for rotation about the longitudinal axis by the hole opener;

a plurality of blades that extend radially outward from the shaft, each of the plurality of blades received within one of the plurality of slots to couple the plurality of blades to the shaft for rotation with the shaft about the longitudinal axis and to space the plurality of blades apart around the longitudinal axis of the shaft;

a plurality of saddles, each of the plurality of saddles including a slot that receives one of the plurality of blades to couple the saddle to the blade and the shaft for rotation with the blade and the shaft about the longitudinal axis, each of the plurality of saddles including a recess;

a plurality of cutting assemblies, each of the cutting assemblies including a body and a cutter coupled to the body, each body being received within one of the recesses of the plurality of saddles to couple each cutting assembly to the shaft for rotation with the shaft about the longitudinal axis and to space the plurality of cutting assemblies around the longitudinal axis of the shaft; and a gauge ring, the gauge ring surrounding the longitudinal axis and including a plurality of saddle recesses spaced circumferentially around the longitudinal axis, wherein each of the plurality of saddle recesses receives one of the plurality of saddles with the saddle intermeshed with the gauge ring and with at least a portion of the body of one of the plurality cutting assemblies having the same axial position along the longitudinal axis as the gauge ring.

2. The hole opener of claim 1, wherein the gauge ring is removably coupled to the shaft, the plurality of blades, and the plurality of saddles.

3. The hole opener of claim 1, wherein one of the plurality of cutting assemblies is removable from the recess of the saddle in which the one of the plurality of cutting assemblies is received while an adjacent cutting assembly remains coupled to the saddle in the recess the adjacent cutter is received.

4. The hole opener of claim 1, wherein each of the plurality of cutting assemblies are removable from the hole opener while adjacent cutting assemblies remain attached to the hole opener.

5. The hole opener of claim 1, wherein the cutter is rotatably coupled to the body such that the cutter rotates about a cutting axis relative to the body such that the cutter is rotatable about both the cutting axis and the longitudinal axis of the shaft.

6. The hole opener of claim 1, further comprising a weld between each of the bodies of the plurality of cutting assemblies and one of the saddles.

7. The hole opener of claim 6, wherein the body of each of the plurality of cutting assemblies is removably coupled with one of the recesses of one of the plurality of saddles.

8. The hole opener of claim 1, wherein the cutter includes material selected from the group consisting of: polycrystalline diamond compact cutters, tungsten carbide cutters, and cubic boron nitride cutters.

9. The hole opener of claim 1, wherein the plurality of cutters are spaced apart around the longitudinal axis of the shaft.

10. The hole opener of claim 9, wherein each of the plurality of cutters are located the same distance from the first end of the shaft.

11. The hole opener of claim 1, further comprising a weld between each of the plurality of blades and the shaft to couple each of the plurality of blades to the shaft.

12. The hole opener of claim 1, further comprising a weld between each of the plurality of saddles and one of the plurality of blades to couple one of the plurality of saddles to one of the plurality of blades.

13. The hole opener of claim 1, further comprising a weld between each of the plurality of saddles and the gauge ring.

14. The hole opener of claim 1, wherein the gauge ring extends between adjacent saddles to interconnect each of the plurality of saddles.

15. The hole opener of claim 1, wherein the plurality of saddle recesses are circumferentially spaced evenly around the longitudinal axis.

16. The hole opener of claim 1, wherein the body includes a first lateral side and an opposite second lateral side, and the saddle is intermeshed with the gauge ring such that at least a portion of both of the first lateral side and the second lateral side face the gauge ring.

17. A hole opener configured for use with a directional drilling rig, the hole opener comprising:

a shaft including a first end, a second end, a longitudinal axis that extends through the first end and the second end, and the shaft configured for rotation about the longitudinal axis by the hole opener;

a plurality of blades that extend radially outward from the shaft, each of the plurality of blades coupled to the shaft for rotation with the shaft about the longitudinal axis and spaced apart around the longitudinal axis of the shaft;

a plurality of saddles, each of the plurality of saddles coupled to one of the plurality of blades and the shaft for rotation with the plurality of blades and the shaft about the longitudinal axis;

a plurality of cutting assemblies, each of the cutting assemblies including a body and a cutter coupled to the body, each body being received within one of the recesses of the plurality of saddles to couple each cutting assembly to the shaft for rotation with the shaft about the longitudinal axis and to space the plurality of cutting assemblies around the longitudinal axis of the shaft; and a gauge ring, the gauge ring surrounding the longitudinal axis and including a plurality of saddle recesses spaced circumferentially around the longitudinal axis, wherein each of the plurality of saddle recesses receives one of the plurality of saddles with the saddle intermeshed with the gauge ring and with at least a portion of the body of one of the plurality of cutting assemblies having the same axial position along the longitudinal axis the gauge ring.

18. The hole opener of claim 17, wherein the cutter is rotatably coupled to the body such that the cutter rotates about a cutting axis relative to the body such that the cutter is rotatable about both the cutting axis and the longitudinal axis of the shaft.

19. The hole opener of claim 17, wherein each of the plurality of cutting assemblies are removable from the hole opener while adjacent cutting assemblies remain attached to the hole opener.

20. The hole opener of claim 17, wherein the body includes a first lateral side and an opposite second lateral side, and the saddle is intermeshed with the gauge ring such that at least a portion of both of the first lateral side and the second lateral side face the gauge ring.

* * * * *